US006976927B2

(12) United States Patent
Cahill

(10) Patent No.: US 6,976,927 B2
(45) Date of Patent: Dec. 20, 2005

(54) BASKETBALL TRAINING DEVICE

(76) Inventor: Timothy M. Cahill, 4214 Yorkshire Ave., Parma, OH (US) 44134-3714

( * ) Notice: Subject to any disclaimer, the term of this patent is extended or adjusted under 35 U.S.C. 154(b) by 0 days.

(21) Appl. No.: 10/789,230

(22) Filed: Feb. 27, 2004

(65) Prior Publication Data

US 2005/0153796 A1 Jul. 14, 2005

Related U.S. Application Data

(60) Provisional application No. 60/535,027, filed on Jan. 8, 2004.

(51) Int. Cl.[7] ..... A63B 69/00
(52) U.S. Cl. ..... 473/449; 473/448
(58) Field of Search ..... 473/447–449, 473/422, 472, 431–435, 479, 481–489, FOR 101; 273/402, 317.3; D21/780; 220/294

(56) References Cited

U.S. PATENT DOCUMENTS

| | | | | |
|---|---|---|---|---|
| 2,694,572 A | | 11/1954 | Crisp | |
| 2,710,189 A | * | 6/1955 | Carroll | 473/449 |
| 2,911,180 A | * | 11/1959 | Dunagan et al. | 248/346.03 |
| 3,122,260 A | * | 2/1964 | Ryan | 220/294 |
| 3,795,401 A | | 3/1974 | Voltz et al. | |
| 3,825,257 A | | 7/1974 | Palmer | |
| 4,921,248 A | * | 5/1990 | Rapp | 473/488 |
| 5,156,394 A | | 10/1992 | Deal | |
| 5,207,789 A | * | 5/1993 | Gates | 473/448 |
| 5,338,023 A | * | 8/1994 | Stovall | 473/485 |
| D365,375 S | | 12/1995 | Lee | |
| 5,816,948 A | * | 10/1998 | Davies et al. | 473/485 |
| 5,823,896 A | | 10/1998 | Pearsall | |
| 5,830,090 A | | 11/1998 | Fitzsimmons et al. | |
| 5,881,583 A | * | 3/1999 | Booker et al. | 70/57 |
| D429,784 S | | 8/2000 | Brown | |
| 6,174,249 B1 | * | 1/2001 | Mattoon | 473/485 |
| 6,572,496 B1 | * | 6/2003 | Brown | 473/449 |
| 2003/0057650 A1 | | 3/2003 | Carter | |

* cited by examiner

*Primary Examiner*—Gregory Vidovich
*Assistant Examiner*—M. Chambers
(74) *Attorney, Agent, or Firm*—Pearne & Gordon LLP

(57) ABSTRACT

A basketball training device can create a mental "target" when shooting a basketball. The device includes an annular shaped member that can be removably attached on top of a rim of a regulation basketball hoop. The annular shaped member includes a flange portion, which substantially covers the rim of the basketball hoop so as to provide a shelf-like image on a top portion of the basketball hoop.

18 Claims, 4 Drawing Sheets

BASKETBALL TRAINING DEVICE

RELATED APPLICATIONS

The application claims the benefit of U.S. patent application Ser. No. 60/535,027 filed on Jan. 8, 2004, the contents of which are incorporated herein by reference in their entirety.

TECHNICAL FIELD

The present invention generally relates to sports training aids. In particular, the present invention relates to a training device for basketball.

BACKGROUND OF THE INVENTION

The sport of basketball continues to be increasingly popular at all levels of play. Children start at a very early age to "shoot baskets", and the best of them will ultimately play organized competitive basketball for many years and may even achieve the level of playing professional basketball. At all levels of play, one of the keys to success is the ability to make a high percentage of goals and with the advent of the three-point goal and with the increased importance of free-throw shooting, improved shooting accuracy is important.

Even gifted athletes have found that the only proven way to improve shooting accuracy is dedication and hard work. In other words, the only way to improve shooting accuracy is to practice and attain a level of shooting confidence that will enable the athlete to perform more successfully no matter at what level the athlete is competing.

Therefore, whether an individual strives to play at a high school, college, or professional level, there is a need for practice or training aid that will enable the individual to improve his or her shooting accuracy.

SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In accordance with an aspect of the present invention, a basketball training device includes an annular shaped member having a first side and a second side, the annular shaped member having a diameter larger than a rim diameter of a basketball hoop. The device further includes a flange that encircles a portion of an outer edge of the annular shaped member and projects downwardly from the second side by a length greater than the rim diameter. The first side of the annular shaped member is substantially smooth and flat; and the annular shaped member can block a basketball from passing through the basketball hoop.

In accordance with another aspect of the present invention, a basketball training device is provided. The training device includes an annular shaped member having an arm, wherein the annular shaped member can be placed on a basketball hoop to prevent a ball from passing through the basketball hoop; and a rod to engage the arm and removably couple the annular shaped member with the basketball hoop.

In accordance with yet another aspect of the present invention, a basketball training device is provided which includes means for creating a shelf-like image on a basketball hoop; and means for removably coupling the basketball training device on the basketball hoop.

To the accomplishment of the foregoing and related ends, the invention then, comprises the features hereinafter fully described. The following description and the annexed drawings set forth in detail certain illustrative aspects of the invention. These aspects are indicative, however, of but a few of the various ways in which the principles of the invention may be employed and the present invention is intended to include all such aspects and their equivalents. Other objects, advantages and novel features of the invention will become apparent from the following detailed description of the invention when considered in conjunction with the drawings.

DETAILED DESCRIPTION OF THE INVENTION

The present invention relates to a basketball training device employed for improving a shooting accuracy of a player. The present invention will now be described with reference to the drawings. It is to be appreciated that the various drawings are not drawn to scale from one figure to another nor inside a given figure, and in particular that the size of the components are arbitrarily drawn for facilitating the reading of the drawings. In the following description, for purposes of explanation, numerous specific details are set forth in order to provide a thorough understanding of the present invention. It may be evident, however, that the present invention may be practiced without these specific details.

Figure 1:
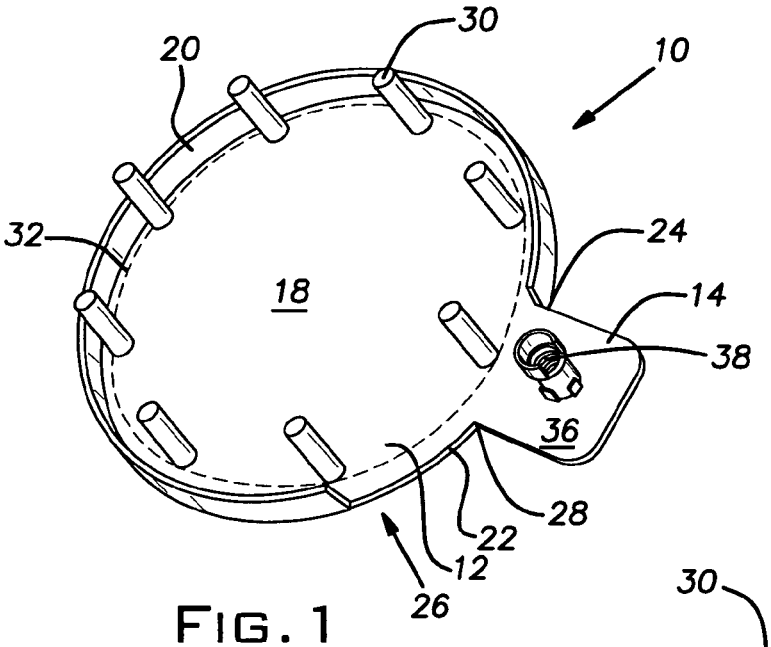
FIG. 1 illustrates a bottom perspective view of a basketball training device in accordance with an aspect of the present invention.
Figure 2:
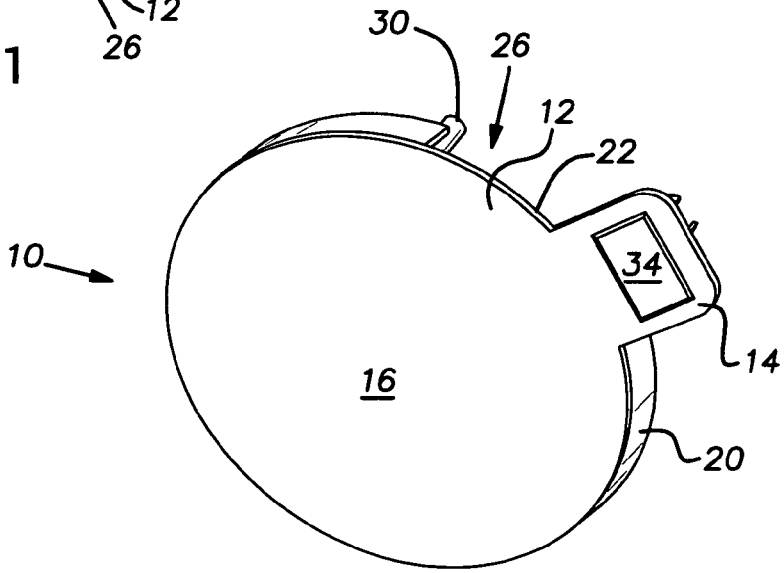
FIG. 2 illustrates a top perspective view of a basketball training device in accordance with an aspect of the present invention.
Figure 3:
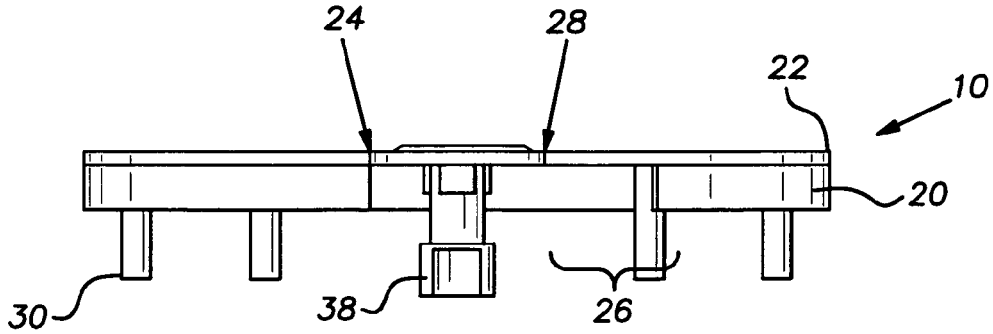
FIG. 3 illustrates a side perspective view of a basketball training device in accordance with an aspect of the present invention.

Referring initially to FIGS. 1–3, perspective views of a basketball training device 10 are illustrated in accordance with an aspect of the present invention. The basketball training device 10 comprises an annular shaped member 12 and an arm 14. The annular shaped member 12 includes a first side 16 and a second side 18. The first side 16 is substantially smooth and flat and forms a top side of the training device 10. The annular shaped member 12 is preferably a solid structure, thereby not having any apertures or voids therein. Accordingly, the annular shaped member 12 is effective in blocking, or preventing, a basketball from passing through the annular shaped member 12 when placed over a basketball hoop. Moreover, because the top side 16 of the annular shaped member 12 is substantially smooth and flat, a basketball can bounce off the top of the annular shaped member 12 without being deflected by any surface irregularities.

A flange 20 projects downwardly from the top side 16 of the device 10, and can be integrally formed with an outer edge 22 of the annular shaped member 12 to create a one-piece structure. The flange 20 and the outer edge 22 diameters are larger than a rim diameter of a basketball hoop. For example, the flange 20 and outer edge 22 diameters can be slightly greater than 18 inches, which is the diameter of a regulation-sized basketball rim. An intersection between the flange 20 and the outer edge 22 of the annular shaped member 12 is preferably smooth and rounded. The flange 20 extends substantially continuously around the circumference of the annular shaped member 12, having a start point at a first intersection 24 between the annular shaped member 12 and the arm 14 and extending over three-fourths of the way around the annular shaped member 12. Accordingly, a cut out portion, or notch, 26 is created between a second intersection 28, which is created between the annular shaped member 12 and the arm 14, and an endpoint of the flange 20. It is to be appreciated that the flange 20 can extend continuously around the annular member 12 by any suitable length such that an appropriate notch, which corresponds with a basketball hoop support flange, is created, as will be discussed in greater detail below. As an alternative to flange 20, a plurality of discontinuous flange portions extending from the outer edge 22 can be employed and is contemplated as falling within the scope of the present invention.

The second side 18 of the annular member 12 includes a plurality of cylindrical projections 30 extending therefrom. The cylindrical projections 30 are illustrated as extending past the flange 20; however, the projections 30 can be of any suitable length. Likewise, the cylindrical projections 30 can be of any suitable diameter and are spaced such that the outer diameters of the cylindrical projections 30 form a circular path 32, which is substantially concentric with respect to the flange 20 and the annular member 12. A distance between the flange 20 and a circular path 32 can correspond with a width of a basketball rim, such that a basketball rim can be received in the area between the flange 20 and the circular path 32. For example, a regulation basketball rim has a minimum diameter of ⅝ inches. Accordingly, the distance between the flange 20 and the circular path 32 is greater than ⅝ inches.

The cylindrical projections 30 are employed to facilitate coupling and securing the basketball training device 10 to a basketball hoop. Accordingly, at least two cylindrical projections 30 can be provided on opposing sides of the annular member 12. For example, at least four cylindrical projections 30 can be spaced at 0-degrees, 90-degrees, 180-degrees, and 270-degrees along the circular path 32. As another example, at least eight cylindrical projections 30 are spaced at 0-degrees, 45-degress, 90-degrees, 135-degrees, 180-degrees, 225-degrees, 270-degrees, and 315-degrees along the circular path 32. However, it is to be appreciated that any number of cylindrical projections can be located at any suitable location along the circular path 32.

The arm portion 14 of the device includes a first side 34 and a second side 36 that corresponds with the first and second sides 16, 18 of the annular member, respectively. The second side 36 includes a rod receiving structure 38 to facilitate removably coupling the basketball training device 10 to a basketball hoop, as will be discussed in greater detail below.

The basketball training device 10 can be constructed of any suitable material, such as a high-impact polymer composite so that it is both lightweight and durable.

Figure 4:
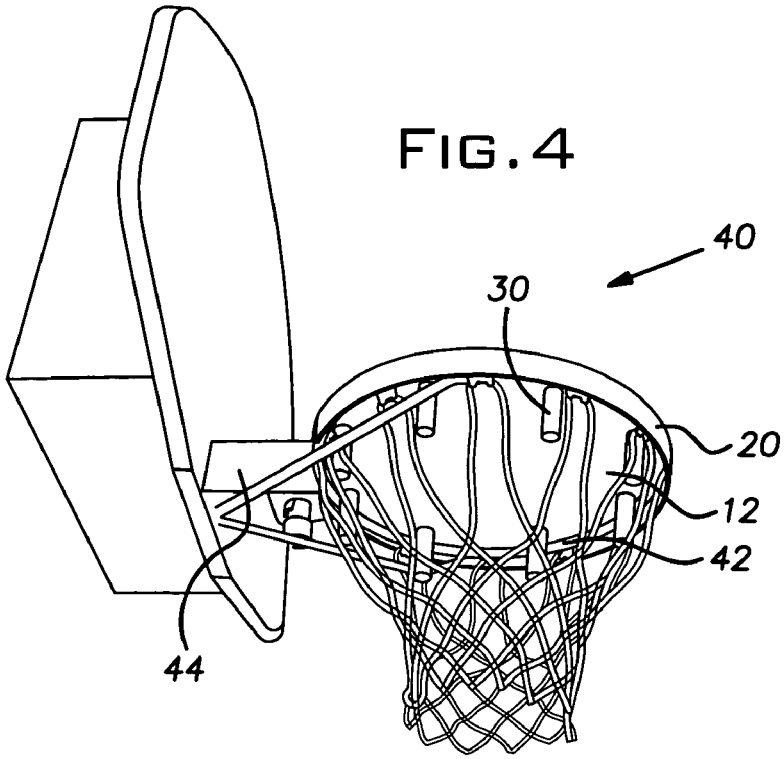
FIG. 4 illustrates a side perspective view of a basketball training device in combination with a basketball hoop in accordance with an aspect of the present invention.
Figure 5:
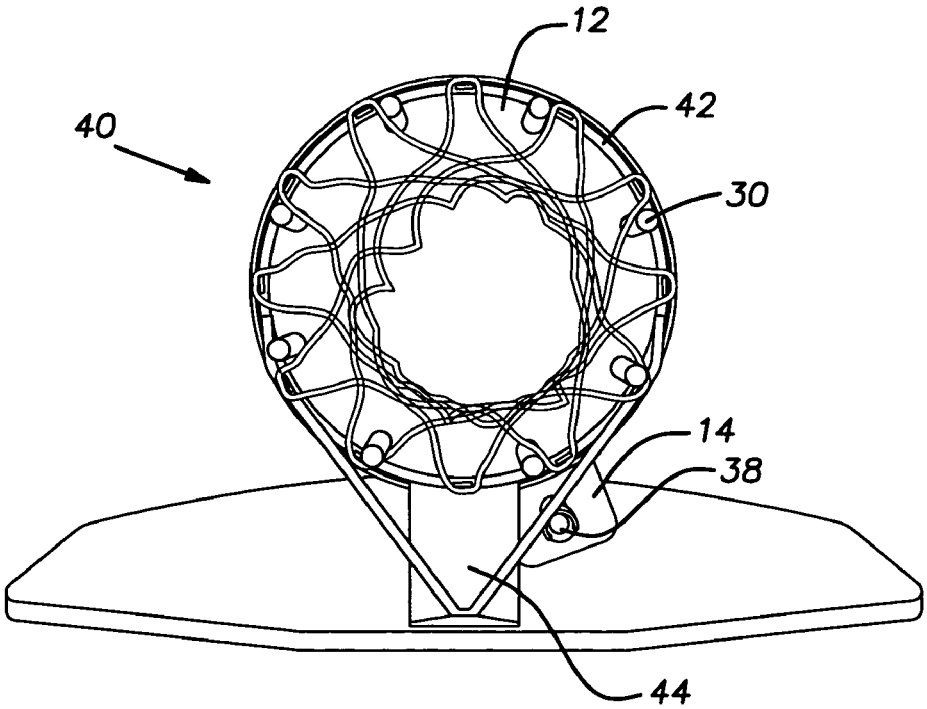
FIG. 5 illustrates a bottom perspective view of a basketball training device in combination with a basketball hoop in accordance with an aspect of the present invention.
Figure 6:
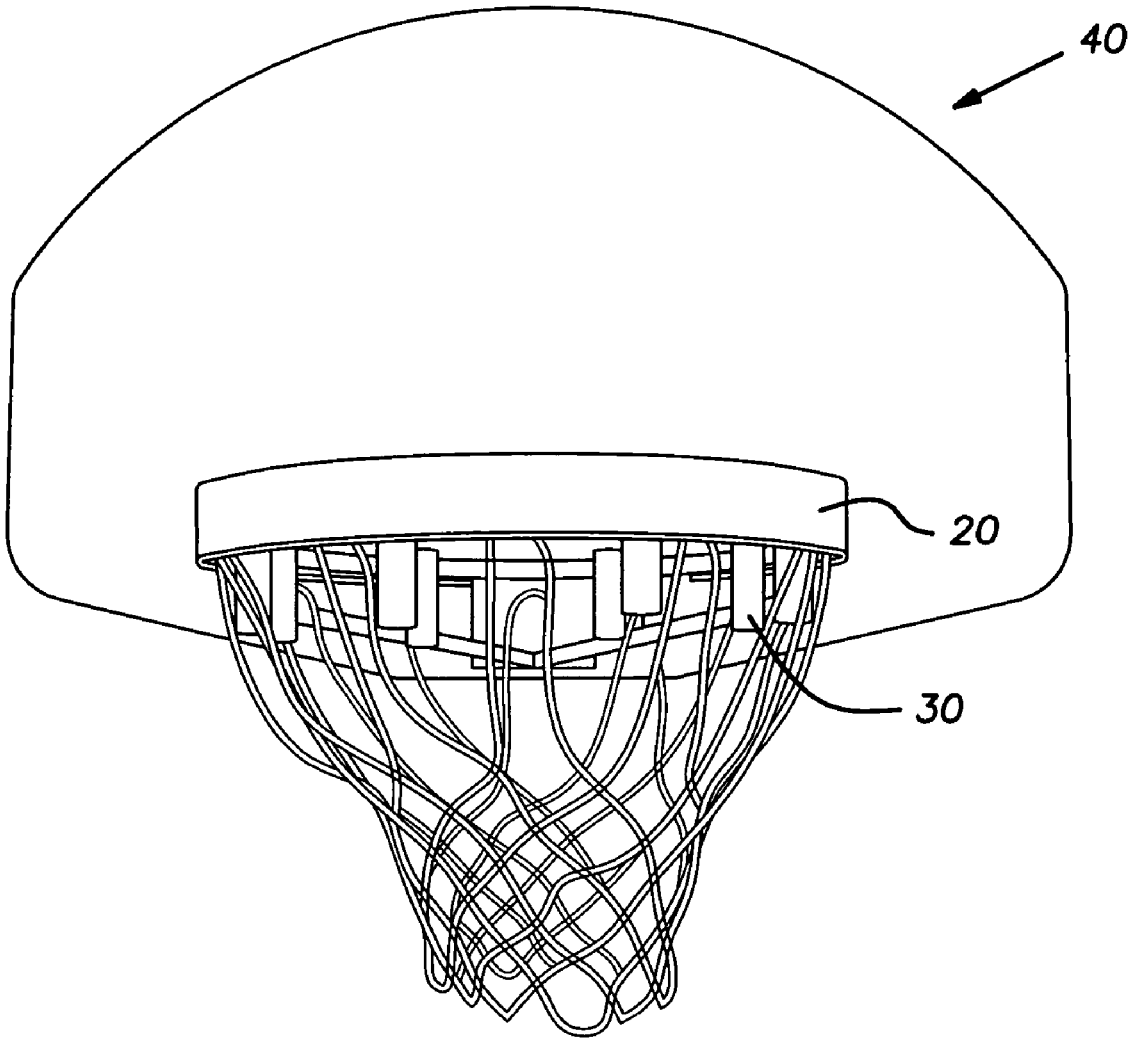
FIG. 6 illustrates a front view of a basketball training device in combination with a basketball hoop in accordance with an aspect of the present invention.

Turning now to FIGS. 4–6, the basketball training device 10 is depicted in combination with a regulation-sized basketball hoop 40. As stated above, the diameters of the flange 20 and the outer edge 22 are slightly greater than an outside diameter of a rim 42 of the basketball hoop 40. Moreover, the flange 20 extends downwards substantially perpendicularly with the annular member 12 by a length greater than the rim diameter. Thus, when the device 10 is placed on top of the basketball hoop 40, the top side 16 of the annular member covers the opening of the hoop 40 and the flange 20 substantially covers the rim 42 of the hoop 40. The flange 20 effectively hides the appearance of the rim 42 from a player and creates a shelf-like image on the top of the basketball hoop 40. When the training device 10 is placed on top of the basketball hoop 40, the rim 42 is located between the flange portion 20 and the plurality of projections 30. The projections 30 secure the training device 10 in place when positioned on the hoop 40.

The training device 10 is positioned on the hoop 40 such that the cut out portion, or notch, 26 receives a support flange 44 for the hoop 40. Accordingly, the training device 10 can be utilized without interference from the support flange 44.

Figure 7:
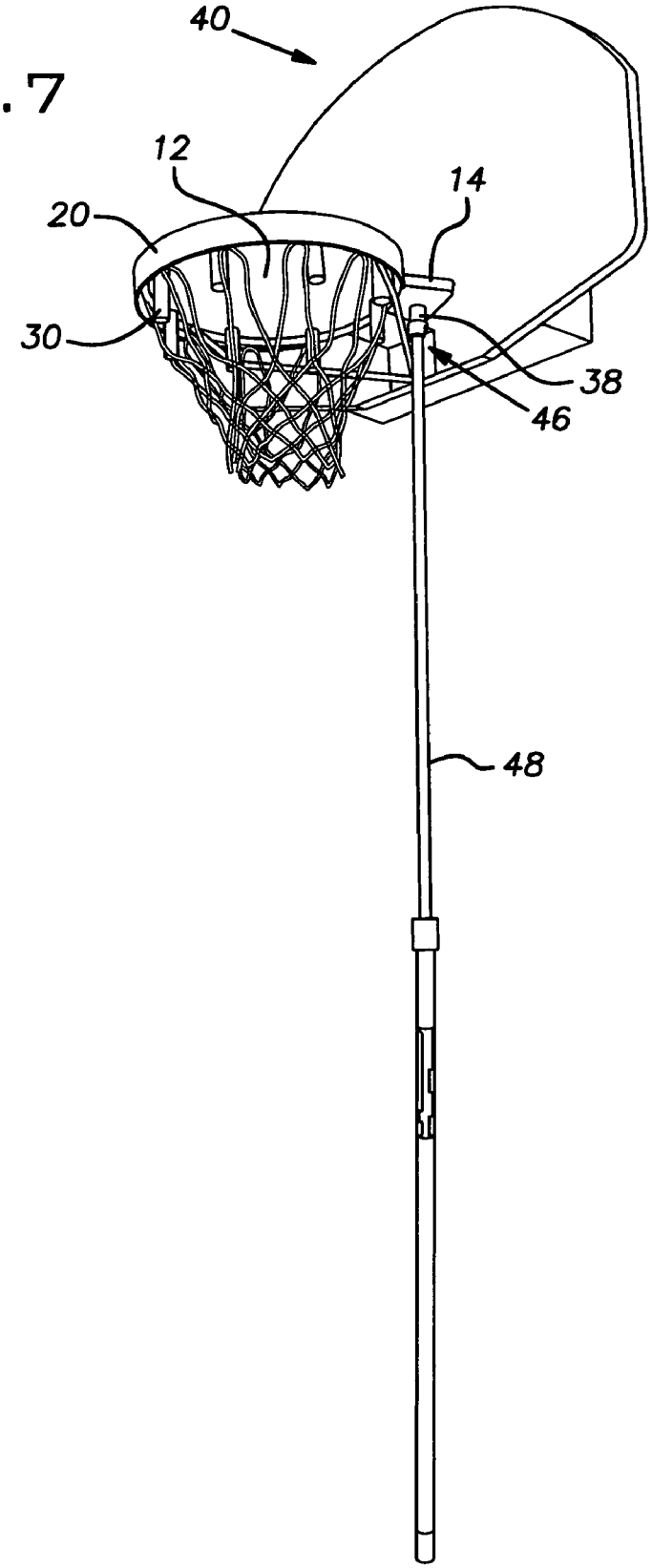
FIG. 7 illustrates a mounting rod for a basketball training device in accordance with an aspect of the present invention.

FIG. 7 illustrates a system for removably coupling the basketball training device 10 with the basketball hoop 40 in accordance with an aspect of the present invention. An end portion 46 of a rod 48 can be employed to selectively engage the arm 14 of the basketball training device 10. For example, the rod receiving structure 38 located in the arm 14 of the training device 10 can be threaded and operable to receive the end portion 46 of the rod 48 or any other suitable structure. The end portion 46 of the rod 48 can include a mating threaded portion to engage with the rod receiving structure 38 of the training device 10. Thus, the rod 48 can be easily threaded into engagement with the device 10 such that a player can utilize the rod 48 to lift up the training device 10 and place the device 10 on, or remove the device 10 from, the basketball hoop 40 when desired. Accordingly, a ladder is not necessary to secure the training device 10 on the hoop 40. Moreover, the training device 10 can be placed on the hoop 40 by any player, such as a young child, and does not require adult interaction to secure the device 10 to the hoop 40.

When the training device 10 is in use, the rod 48 can be easily disengaged and removed from the device 10 such that it does not interfere with the use of the basketball hoop 40. When a player is finished practicing, or training, and wishes to use the basketball hoop 40 without the training device 10, the device 10 can be easily removed from the hoop 40 by use of the rod 48, as the training device 10 is not secured to the rim 42 via any type of screw, magnet, or snap fit structures. It is to be appreciated that any suitable connection for securing the rod 48 to the device 10 can be employed and is contemplated as falling within the scope of the present invention. For example, the end portion 46 of the rod 48 and the rod receiving structure 38 of the training device can include mating magnets and/or mating snap fit structures. The rod 48 can include a plurality of sections coupled together such that the rod 48 can be taken apart and easily portable when not in use.

Once properly positioned on the hoop 40, the basketball training device 10 creates a mental image of a "shelf" on top of the basketball hoop 40 for a player. The player uses the shelf image to create a mental target of placing the basketball on top of the shelf with a goal to bounce the ball as straight up in the air off the shelf as possible. It is substantially easier to see a shelf and shoot the basketball such that it lands on top of the shelf than it is to see a rim, visualize placing the ball through the basket, and shoot the basketball such that it travels through the basket. Accordingly, the shelf image provides a different visual and mental representation of a basketball hoop for the player. When the training device 10 is removed, the same process of shooting the basketball with the mental image that the shelf is still there is applied. However, the ball will travel through the hoop 40 rather than bouncing on the training device 10. The training device 10 is thereby employed to train the mind to see the shelf every time a shot is attempted.

What has been described above includes exemplary implementations of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A basketball training device comprising:

a basketball hoop having a rim;

an annular shaped member having a first side and a second side, the annular shaped member having a diameter larger than a rim diameter of the basketball hoop; and a flange that encircles a majority of a circumference of an outer edge of the annular shaped member and projects downwardly from the second side by a length greater than a cross-sectional rim diameter, wherein the first side of the annular shaped member is substantially smooth and flat, and wherein the annular shaped member can block a basketball from passing through the basketball hoop.

2. The basketball training device of claim 1, wherein the flange is integrally formed with the outer edge of the annular shaped member to create a one-piece structure.

3. The basketball training device of claim 1, further comprising an arm that extends from the annular shaped member.

4. The basketball training device of claim 3, wherein the arm includes a rod receiving structure to receive an end portion of a rod.

5. The basketball training device of claim 4, wherein the rod receiving structure includes at least one of a threaded portion, a magnetic portion, and a snap fit portion.

6. The basketball training device of claim 1, wherein a notch is created in the flange, the notch being adapted to receive a support structure for the basketball hoop.

7. The basketball training device of claim 1, wherein the first side of the annular shaped member is entirely smooth and flat.

8. The basketball training device of claim 1, wherein the annular shaped member has a circular configuration.

9. The basketball training device of claim 1, further comprising a plurality of protrusions extending from the second side of the annular shaped member.

10. The basketball training device of claim 9, wherein the protrusions create a circular path that is concentric with the flange.

11. The basketball training device of claim 10, wherein a distance between the flange and the circular path is greater than the cross-sectional rim diameter.

12. The basketball training device of claim 9, wherein the flange and the protrusions create an area to receive the basketball rim.

13. The basketball training device of claim 1, wherein the annular shaped member and the flange are constructed from a high-impact polymer composite.

14. A basketball training device comprising:

a basketball hoop having a rim;

an annular shaped member having a first side and a second side, the annular shaped member having a diameter larger than a rim diameter of the basketball hoop; and a flange that encircles a portion of an outer edge of the annular shaped member and projects downwardly from the second side by a length greater than a cross-sectional rim diameter, wherein the first side of the annular shaped member is substantially smooth and flat, and wherein the annular shaped member can block a basketball from passing through the basketball hoop, further comprising a plurality of protrusions extending from the second side of the annular shaped member, wherein the protrusions are cylindrical protrusions.

15. A basketball training device comprising:

an annular shaped member, wherein the annular shaped member can be placed on a basketball hoop to prevent a ball from passing through the basketball hoop;

a flange that encircles a majority of a circumference of an outer edge of the annular shaped member;

a handle for positioning and removing said annular shaped member; and said handle comprising a rod to engage and removably couple the annular shaped member with the basketball hoop.

16. The basketball training device of claim 15, wherein the arm includes a rod receiving structure to receive the rod.

17. The basketball training device of claim 15, wherein the annular shaped member is secured to the basketball hoop via the flange and a plurality of protrusions extending downwardly from the annular shaped member.

18. A basketball training device comprising:

an annular shaped member having an arm, wherein the annular shaped member can be placed on a basketball hoop to prevent a ball from passing through the basketball hoop;

a flange that encircles a majority of a circumference of an outer edge of the annular shaped member; and a rod to engage the arm and removably couple the annular shaped member with the basketball hoop, wherein the rod includes a plurality of sections such that the rod can be taken apart and easily portable.

* * * * *